United States Patent [19]

Potvin

[11] Patent Number: 4,951,328

[45] Date of Patent: Aug. 28, 1990

[54] SWIVEL OPEN BOTTOM SEAT ASSEMBLY FOR INVALIDS

[75] Inventor: Alfred Potvin, Montreal, Canada

[73] Assignee: Promed Inc., Montreal, Canada

[21] Appl. No.: 288,222

[22] Filed: Dec. 22, 1988

[51] Int. Cl.[5] ..... A47K 3/12

[52] U.S. Cl. ..... 4/560; 4/254; 4/578; 297/349

[58] Field of Search ..... 4/251, 254, 560–563, 4/578, 579, 604; 297/349; 248/215, 216, 217, 218, 225

[56] References Cited

U.S. PATENT DOCUMENTS

| | | | |
|---|---|---|---|
| 766,320 | 8/1904 | Brown | 4/578 X |
| 1,076,808 | 10/1913 | Arburg | 4/578 |
| 2,052,628 | 9/1936 | Higgins | 4/578 |
| 2,293,144 | 8/1942 | Jones | 297/349 |
| 2,664,142 | 12/1953 | Scheuerman et al. | 4/578 X |
| 2,679,890 | 6/1954 | Zannoth | 4/560 X |
| 3,022,518 | 2/1962 | Hayden | 4/578 X |
| 3,203,008 | 8/1965 | Murcott | 4/561 |
| 3,572,831 | 3/1971 | Barecki | 297/349 |
| 3,815,163 | 6/1974 | Sullivan | 4/562 |
| 3,879,770 | 4/1975 | Grant | 4/578 X |
| 3,918,108 | 11/1975 | Feyerherm | 4/251 X |
| 3,960,406 | 6/1976 | Buker | 297/349 X |
| 4,487,452 | 12/1984 | Tanizaki et al. | 297/349 |
| 4,518,139 | 5/1985 | Barfell | 297/349 X |
| 4,628,550 | 12/1986 | Walton | 4/560 |

FOREIGN PATENT DOCUMENTS

| | | | |
|---|---|---|---|
| 709113 | 5/1965 | Canada | 4/563 |
| 1127803 | 7/1982 | Canada | 4/300 |
| 2228963 | 1/1973 | Fed. Rep. of Germany | 4/563 |

OTHER PUBLICATIONS

Turner Applicator Co., "The Cootur Hydraulic Bathtub Seat", date unknown.

*Primary Examiner*—Henry J. Recla
*Assistant Examiner*—R. M. Fetsuga

[57] ABSTRACT

A swivel open bottom seat assembly for invalids for use in supporting an invalid over a toilet seat, a shower head or a bathtub or the like facilities. In one application, the seat is secured to a pivot post via a connecting arm extending from the post. The pivot post has an attachment base for securement to the floor adjacent a facility. The pivot post is pivotally rotatable with respect to a central longitudinal axis and permits the seat to be displaced on an arc relative to the axis of the post to position the post from an embarking position away from the facility to a position of use over or in the facility.

14 Claims, 4 Drawing Sheets

SWIVEL OPEN BOTTOM SEAT ASSEMBLY FOR INVALIDS

BACKGROUND OF INVENTION (a) Field of the Invention

The present invention relates to a swivel open bottom seat assembly for invalids and for use in conjunction with a facility, such as a toilet.

(b) Description of Prior Art

Handicapped people all have encountered many difficulties in using facilities, and particularly invalids who are demembered or who have to use a wheelchair to displace themselves. In particular, they experience great difficulty and require assistance from another person when using a facility such as a toilet, bathtub, shower, etc. Very few devices have been heretofore provided to help such handicapped people. Often, in bathrooms, the only device which is provided is a handlebar secured to a wall close to the facility so that certain persons can support themselves by using their arms. However, if such person cannot use his arms, he cannot utilize the facility on his own.

SUMMARY OF INVENTION

It is a feature of the present invention to provide a swivel open bottom seat assembly for invalids which substantially overcomes the above-mentioned disadvantages.

According to a further feature of the present invention, there is provided a swivel open bottom seat assembly for invalids and wherein the invalid can position himself on the seat assembly at an embarking position away from a facility and then displace the seat to a position of use over the facility.

Another feature of the present invention is to provide a swivel open bottom seat assembly for invalids which is easy to use, easy to install, which is safe to use and secure, which is adjustable and adaptable to various types of facilities and which requires little repair and service.

According to the above features, from a broad aspect, the present invention provides a swivel open bottom seat assembly for invalids. The assembly comprises a pivot post having an attachment base for securement to a floor adjacent a facility. An open bottom seat is provided and has a connecting arm extending therefrom and connected to a pivot member pivotally rotatable with respect to a central vertical axis of the post and permits the seat to be displaced on an arc relative to the axis to position the seat from an embarking position away from a facility to a position of use over or in the facility.

According to a further broad aspect of the present invention, there is provided a swivel toilet seat assembly for invalids. The assembly comprises a toilet seat support frame having attachment means to dispose same over an open top end of a toilet. Bearing support means are disposed on a circular arc in a top wall of the support frame. A toilet seat is displaceably connected over the support frame and has a flat planar surface disposed over the bearing support means whereby the toilet seat can rotate over the support frame.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
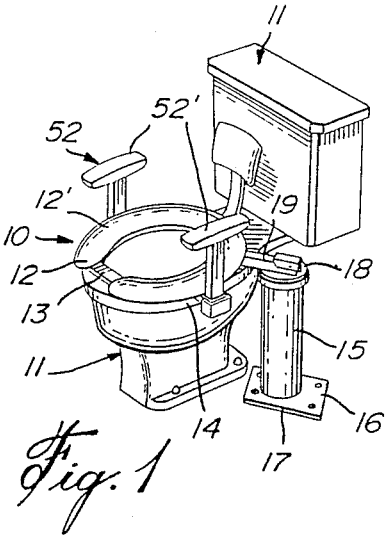
FIG. 1 is a perspective view of a swivel open bottom seat assembly which is secured adjacent a toilet.
Figure 3:
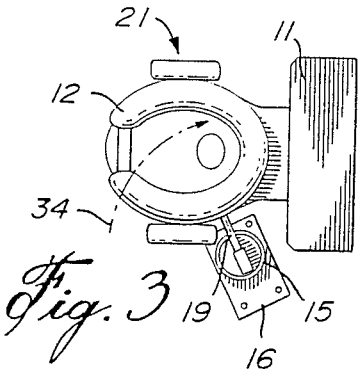
FIG. 3 is a view similar to FIG. 2 but showing the open bottom seat in a position of use over a toilet bowl.
Figure 2:
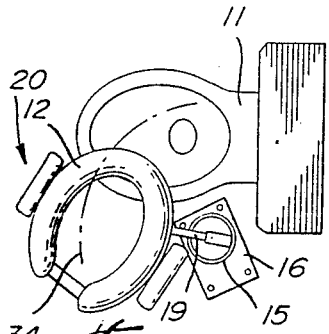
FIG. 2 is a top view of FIG. 1 illustrating the open bottom seat disposed at an embarking position.

Referring now to the drawings and more particularly to FIGS. 1 to 3, there is shown generally at 10, a swivel open bottom seat assembly constructed in accordance with the invention and for use by invalids to position themselves over a facility, herein a toilet 11. As herein shown, the assembly comprises a toilet seat 12 secured to a support frame 13 which is itself supported elevated over the toilet bowl 14 by a pivot post 15. The pivot post is secured to a floor by an attachment flange 16 having fasteners 17 secured in each corner thereof. The support frame 13 is interconnected to a pivot member 18 or shaft through a connecting arm 19. The pivot member 18 is pivotally rotatable with respect to a central vertical axis extending centrally of the pivot post 15 whereby to permit the seat to be displaced from an embarking position 20 as shown in FIG. 2, to a position of use 21, as shown in FIG. 3.

Figure 4:
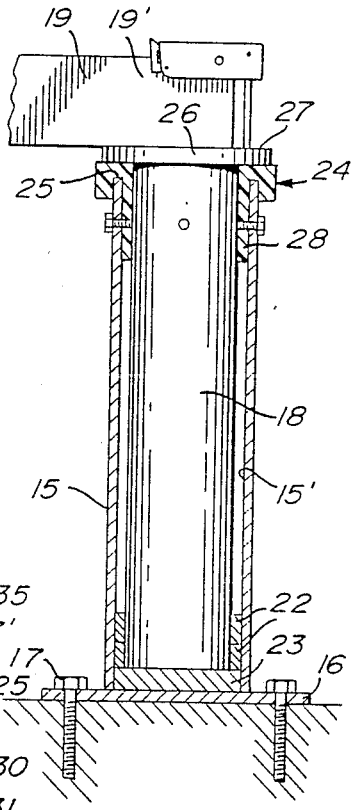
FIG. 4 is a partly fragmented section view showing the construction of the pivot post.
Figure 5:
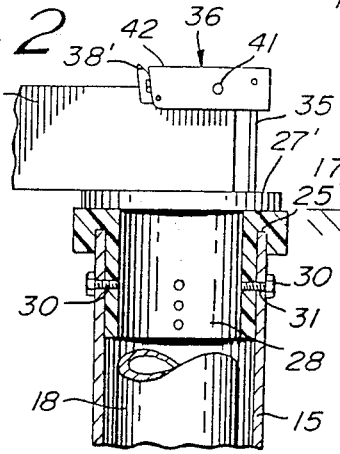
FIG. 5 is a fragmented section view similar to FIG. 4 with the cylinder housing and pivot post partly fragmented.
Figure 5:
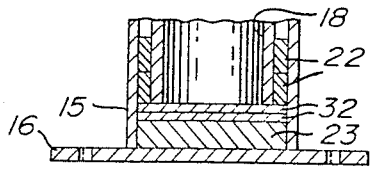
Figure 6:
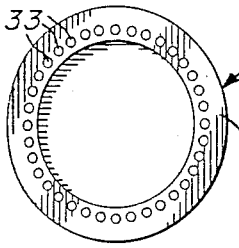
FIG. 6 is a top view of the annular support bushing.

Referring now to FIGS. 4 to 6, there will be described the construction of the pivot post. As herein shown, the pivot member 18 is constituted by a steel tube or a pivot rod which is of circular cross-section and disposed within the piston post which is a hollow, open-top end cylinder 15. The cylinder 15 is also of circular cross-section. One or more spacer sleeves 22 are positioned intermediate the pivot post and the inner wall 15' of the cylinder 15 to provide support and axial rotation of the pivot post 18 in the cylinder. A spacer disc 23 is disposed in close fit with the cylinder at the bottom thereof and rests on the connecting flange 16.

An annular support bushing 24 is disposed about the open top end 25 of the cylinder 15. As can be seen, the connecting arm 19 is provided with a seating annular flange 26 at its connecting point with the pivot rod 18. The connecting flange 26 has a flat bottom face resting on the flat annular shoulder 27 of the arm support bushing 24 for seating thereon. The bushing 24 is constructed of nylon to offer very little frictional resistance with the annular flange 26.

The support bushing 24 is further provided with a sleeve section 28, as best seen in FIG. 5, which extends in close fit into a top end portion of the cylinder 15. The sleeve section 28 is provided with adjustable means, constituted by at least two series of axially aligned spaced-apart holes 29 disposed in the sleeve section and in substantially opposed wall portions of the bushing. These series of holes 29 permit the bushing to be secured to the top end portion of the cylinder, at a desired adjustable height from the top end 25 of the pivot post. This is done by connecting pins 30 which extend through a plurality of holes 31 associated with each series of holes 29. Accordingly, if the support frame 13 of the toilet seat 12 is to be disposed slightly higher, then the support bushing 24 is moved up in the top end of the cylinder. Still further, in order to support the pivot rod 18, one or more spacer discs 32 are seated over the bottom disc 23 and on which rests the pivot rod 18. Accordingly, there is no excessive strain on the arm support bushing 24 to subject it to unnecessary wear. The spacer discs 32 have a thickness corresponding to the distance between adjacent holes 29.

As shown in FIG. 6, the arm support bushing 24 is further provided with a series of spaced-apart arresting holes 33 disposed in a spaced-apart manner about the periphery of the top wall 27' of the bushing 24. These holes are best illustrated in FIG. 7.

Figure 7:
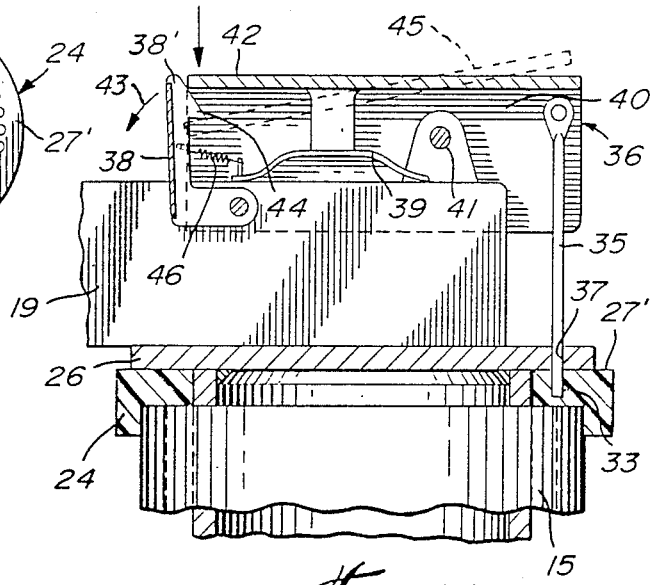
FIG. 7 is a fragmented perspective view illustrating the operation of the adjustable locking device.

Referring now additionally to FIG. 7, there will be described the construction of the adjustable lock means to lock the connecting arm 19 at any desired position, be it the embarking position 20 as shown in FIG. 2, or the position of use 21 or any other position on the swivel arc 34 as shown in FIGS. 2 and 3. The adjustable lock means is provided between the seating annular flange 26 and the annular support bushing 24. The adjustable lock means also includes an arresting pin 35 which is removably positioned in aligned ones of the holes 33. The arresting pin is secured to a spring latch mechanism 36 which biases the arresting pin 35 downwardly through a guide hole 37 in the seating annular flange 26 towards a top end of the holes 33 in the bushing 24. A spring latch 38 disables the latch mechanism 36 to maintain the arresting pin 35 out of the holes 33 thereby unlocking the connecting arm 19 permitting the seat assembly to swivel. A leaf spring 39 biases the latch cover in the position as shown in FIG. 7 pushing the latch cover upwardly on its pivot connection 41 until the arresting pin 35 seats at the bottom of the holes 33. By pressing on the front end portion 42 of the latch cover 40, the spring latch 38 is moved outwardly in the direction of arrow 43 and its prong end 44 moves over the front end of the latch cover 40 when positioned thereover to arrest the cover at a tilted angle as illustrated by the tilt line 45 to maintain the arresting pin 35 out of the holes 33 but still within the guide hole 37. A spring 46 biases the spring latch member 35 in an engaged position. In order to re-engage the arresting pin, all that is necessary to do is to pull back on the top end 38' of the spring latch, in the direction of arrow 43, and the arresting pin is then biased downwardly towards the holes 33. If the pin is not in line with a hole, all that is necessary to do is to displace the seat slightly until the pin moves into a hole. As herein shown, holes are positioned every tenth degree about the bushing 24.

Figure 8:
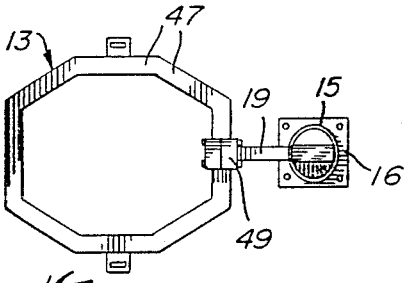
FIG. 8 is a top view of the seat support frame attached to the connecting arm of the pivot post.
Figure 9:
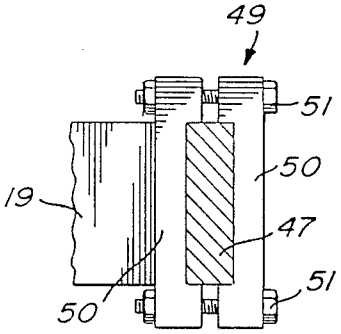
FIG. 9 is a side view of the attachment securing the connecting arm to the seat support frame.

Referring now to FIGS. 8 and 9, there is shown the construction of the seat support frame 13, and as herein shown, it is formed from steel stock of rectangular cross-section and formed as an octagon. The connecting arm 19 can be connected to any one of the legs 47 of the octagon. This connection can be made by a clamp 49, as shown in FIG. 9, and which is secured at the free end of the connecting arm 19. The clamp is provided with opposed shoe members 50 interconnected by bolts 51. The shoes 50 receive therein one of the legs 47 of the support frame and can be clamped at any location along any of the legs 47 of the octagon frame. Thus, there is provided infinite adjustment to adapt a seat to any utility or for any use. The support frame and also the seat is adjusted angularly with respect to the connecting arm 19 and is also adjustable in elevation with respect to the top end of the support cylinder 15.

Figure 10:
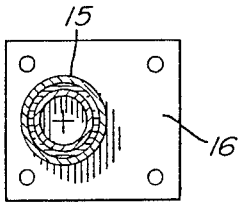
FIG. 10 is a top view illustrating the relationship between the pivot post and the attachment base.

As shown in FIG. 10, the cylinder 15 is also secured in an offset position with respect to the attachment base 16. The purpose of this is to locate the post as close as possible, when necessary, to a facility.

Figure 11:
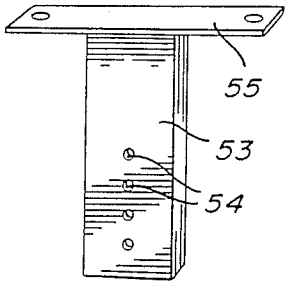
FIG. 11 is a perspective view of an adjustable side arm associated with the seat.
Figure 12:
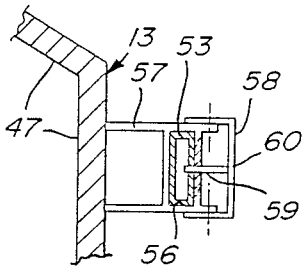
FIG. 12 is a fragmented section view illustrating the principle of the adjustment mechanism for the arm.
Figure 13:
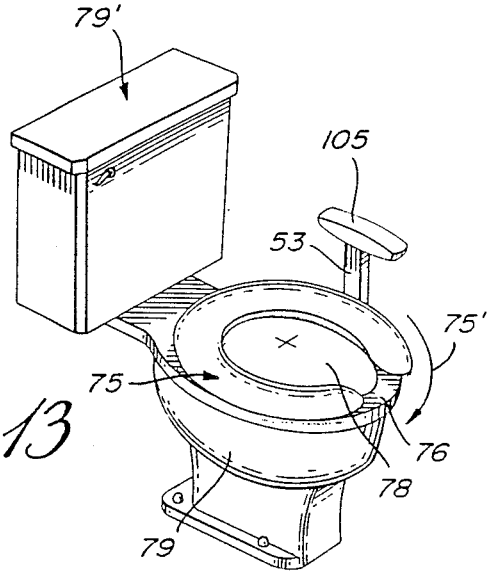
FIG. 13 is a perspective view of another example of the construction of a swivel toilet seat assembly.
Figure 14:
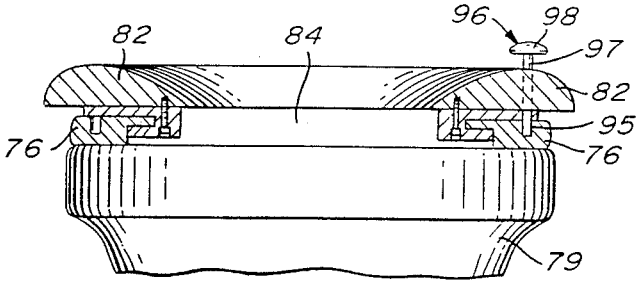
FIG. 14 is a section view of the swivel toilet seat assembly of FIG. 13.
Figure 15:
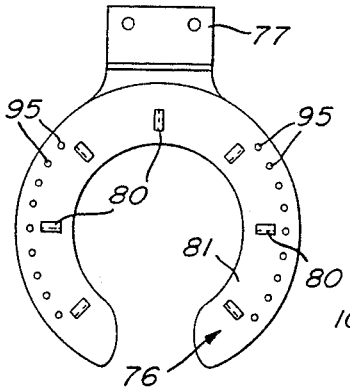
FIG. 15 is a plan view showing the construction of the toilet seat support frame.

Referring again to FIG. 1 and FIGS. 11 and 12, it can be seen that the seat assembly is also provided with armrests 52. These armrests 52 are also adjustable in height and may be lowered to a position which extends at or below the top surface 12' of the seat 12. As shown in FIG. 11, the armrest is provided with a support post 53 having a plurality of axially aligned through holes 54 therein. An armrest flange 55 is provided in a top end thereof on which is secured a padded armrest 52' as shown in FIG. 1. The support post 53 is slidingly secured in a channel 56 provided at a free end of a support flange 57 extending from the seat support frame 13, as shown in FIG. 12. A securing latch mechanism 58, constructed as shown in FIG. 7, may also be provided at the free end of the support frame 57 to move a lock pin 59 in and out of engagement with the holes 54. By pushing one end of the latch cover 60, in a similar manner to the latch described in FIG. 7, the pin can be permanently disengaged to lower the arm completely.

Referring now to FIGS. 13 to 17, there will be described another construction of a swivel toilet seat assembly. The swivel toilet seat assembly 75 is comprised of a toilet seat support frame 76 having attachment means 77 (see FIG. 15) to secure the frame over an open top end 78 of a toilet bowl 79. Bearing support means, in the form of roller bearings 80, are disposed on a circular arc in a top wall 81 (see FIG. 17) of the support frame. A toilet set 82 is displaceably connected over the support frame 76 and has a flat planar bottom surface 83 disposed over the bearings 80 whereby the toilet seat can rotate over the support frame. It is pointed out that the bottom surface of the toilet seat may not be totally flat as long as there is a flat wall adjacent the bearing 80.

The toilet seat 82 is displaceably connected to the support frame 76 by means of a flange connector 84 which is secured under the toilet seat 82. As more clearly shown in FIG. 17, the flange connector 84 has a connecting flange 85 engaged under a projecting friction flange 86 of the frame 76. The arcuate connecting flange 85 is disposed under and closely spaced to the projecting arcuate flange 86 and need not be in friction contact therewith. The frame and the seat also have an open front end, as is customary with toilet seats. The flange also has a connecting flange portion 87 with holes therein whereby fasteners 88 may connect it to the seat 82. A nylon strip or a plurality of nylon pads 89 may be secured on a rear surface of the connecting flange 85 for smoother swivelling.

Figure 17:
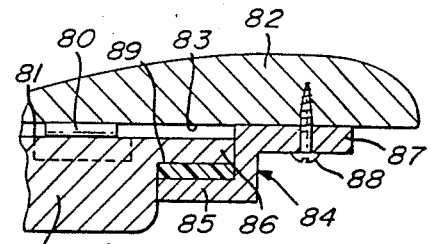
FIG. 17 is a fragmented section view showing the interconnection between the toilet seat support frame and the toilet seat showing the construction of the flange connector.
Figure 18:
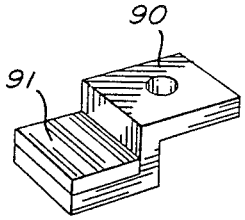
FIG. 18 is a perspective view showing another type of flange connector.
Figure 19:
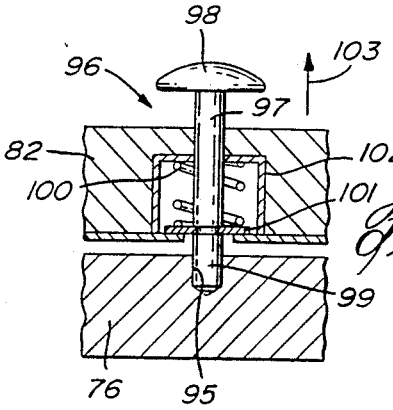
FIG. 19 is a fragmented section view showing the construction of the seat arresting mechanism.

FIG. 18 shows another alternative embodiment of the connector. As herein shown, a plurality of connector clamps 90 may be secured spaced-apart under the seat 82 to connect the seat to the support frame 76. The connector 90 may also be provided with a nylon frictionless bushing 91 to remove friction. This connector would be secured in the same manner as the other connector and as illustrated in FIG. 17.

Figure 16:
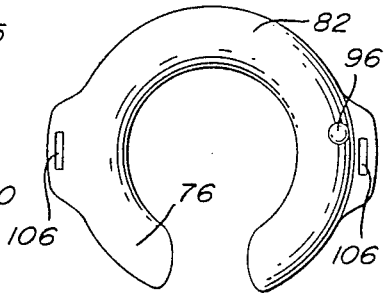
FIG. 16 is a plan view showing the construction of the swivel toilet seat.

In order to arrest the seat 82 on the stationary support frame 76, and at a desired position, there is provided a plurality of holes 95 disposed to each side of the support frame 76 and equidistantly spaced-apart at about 10° from the center point of rotation. A lock member 96 is also provided in the seat 82 and aligned with the arc on which lie the holes 95. This lock consists of a downwardly biased lock pin 97 which has a retractable head 98 engageable by the fingers whereby to move the locking end 99 of the pin out of engagement with one of the holes 95. A spring 100 biases the lock pin 97 downwardly. The spring 100 is located in compression between a flange 101 secured to the pin and the bottom end of a spring housing 102. By pulling upwardly in the direction of arrow 103, the pin moves out of the locking holes 95 and the seat is free to rotate on the support frame. If desired, a suitable latch member could be engaged with the head 98 of the lock pin to retain it in a disengaged position. The advantages of this lock mechanism are many. For example, if an invalid having no legs wishes to position himself on the seat, he firstly rotates the seat, as shown by arrow 75' in FIG. 13, with the opening of the seat facing the toilet tank 79'. He then embarks onto the seat facing the toilet tank and rotates himself around to face outwardly and then locks the seat in position. Armrests 105 are also provided on both sides of the seat and are located in armrest cavities 106 as shown in FIG. 16. They may also be adjustable, as previously described, with references to FIGS. 11 and 12. In order to disembark, the invalid then rotates the seat again facing the toilet tank and locks the seat. By supporting himself on the armrest, he pushes himself off the seat and onto his wheelchair which has been positioned in front of the toilet with the wheels locked in position.

There are numerous other advantages not described herein but which become readily obvious to people skilled in the art and understandable of the problems that invalids face when using various types of facilities. For example, the posts and the swivel seat may be positioned adjacent a bathtub under a shower head. By swivelling the seat immediately over the bathtub and under the shower head, the invalid can take a shower without the assistance of anyone. He can thereafter swivel himself back onto his wheelchair or other device which he uses for assistance.

It is within the ambit of the present invention to cover any obvious modifications, provided such modifications fall within the scope of the appended claims.

I claim:

1. A swivel apertured toilet seat assembly for invalids, said assembly comprising a cylinder of circular cross-section having an attachment base for securement to a floor adjacent a facility, a pivot rod disposed concentrically in said cylinder for axial rotation therewith, and one or more spacer sleeves intermediate said pivot rod and an inner wall of said cylinder to provide for axial rotation of said pivot rod in said cylinder, an apertured toilet seat having a connecting arm extending therefrom and connected to said pivot rod to provide for said seat to be displaced on an arc relative to a central vertical axis of said rod to position said seat from an embarking position to a position of use and an annular support bushing disposed about an open top end of said cylinder, said connecting arm being secured to a top end of said pivot rod and having a seating annular flange at said top end of said pivot rod for seating engagement on a low friction annular top wall of said support bushing.

2. A swivel apertured toilet seat assembly as claimed in claim 1 wherein said facility is a toilet.

3. A swivel apertured toilet seat assembly as claimed in claim 2 wherein said toilet seat is secured to a seat support frame to which said connecting arm is secured.

4. A swivel apertured toilet seat assembly as claimed in claim 3 wherein said seat support frame is a peripheral frame having a plurality of connectors about its outer periphery whereby said connecting arm is secured to a desired selected one of said connectors.

5. A swivel apertured toilet seat assembly as claimed in claim 3 wherein said seat is further provided with side armrests, said side armrests being adjustable in height above said seat by arm adjustment means secured to said seat support frame.

6. A swivel apertured toilet seat assembly as claimed in claim 5 wherein said side armrests are slidingly secured in a clamp secured to a support flange connected to said seat support frame and extending from under said toilet seat whereby said armrests may be lowered to at least the plane of said toilet seat to provide sliding access to said seat from a side thereof when necessary.

7. A swivel apertured toilet seat assembly as claimed in claim 2 wherein there is further provided adjustable lock means to arrest said connecting arm at said embarking position and position of use.

8. A swivel apertured toilet seat assembly as claimed in claim 1 wherein said support bushing is provided with a sleeve section extending in close fit into a top end portion of said cylinder, said sleeve section having adjustable means to secure said annular top wall at a desired adjustable height from said top end of said cylinder.

9. A swivel apertured toilet seat assembly as claimed in claim 5 wherein said pivot rod has a flat bottom wall, there further being provided one or more spacer discs seated on a bottom wall of said cylinder to support said pivot rod spaced from said bottom wall of said cylinder a distance equal to the spacing between said annular top wall of said bushing and said top end of said cylinder.

10. A swivel apertured toilet seat assembly as claimed in claim 8 wherein said adjustable means is comprised by at least two series of axially aligned spaced-apart holes disposed in said sleeve section of said support bushing and in substantially opposed wall portions of said bushing, and at least two exterior holes in said top end of said cylinder spaced from one another and aligned with a respective one of said at least two series of spaced-apart holes, and a lock pin disposed in a respective one of said two exterior holes and extending in a selected hole of a corresponding series of holes to support said bushing at said desired adjustable height.

11. A swivel apertured toilet seat assembly as claimed in claim 1 wherein there is further provided adjustable lock means provided between said seating annular flange and said annular support bushing whereby to arrest said seat at a desired location relative to said cylinder and said facility.

12. A swivel apertured toilet seat assembly as claimed in claim 11 wherein said adjustable lock means is constituted by a series of spaced-apart holes disposed in said annular support bushing, and an arresting pin positioned in a hole provided in said seating annular flange and axially alignable with said series of spaced-apart holes.

13. A swivel apertured toilet seat assembly as claimed in claim 12 wherein said arresting pin is secured to a spring latch mechanism which spring biases said arresting pin towards a top end of said holes in said annular support bushing.

14. A swivel apertured toilet seat assembly as claimed in claim 13 wherein said spring latch mechanism is provided with a locking member to disable said latch mechanism to maintain it at an unlocked position.

* * * * *